United States Patent [19]

Bosisio

[11] Patent Number: 4,539,945

[45] Date of Patent: Sep. 10, 1985

[54] INTERNAL COMBUSTION POWER PACK WITH INJECTION PUMP VENTILATION SYSTEM

[75] Inventor: Roberto Bosisio S.p.A., Treviglio, Italy

[73] Assignee: SAME S.p.A., Treviglio, Italy

[21] Appl. No.: 613,208

[22] Filed: May 23, 1984

[30] Foreign Application Priority Data

May 31, 1983 [IT] Italy ..... 22002/83[U]

[51] Int. Cl.[3] ..... F02B 77/00

[52] U.S. Cl. ..... 123/41.31; 123/41.56; 123/198 E; 123/195 C; 239/128

[58] Field of Search ..... 123/41.31, 41.56, 41.6, 123/198 E, 195 C; 239/128

[56] References Cited

U.S. PATENT DOCUMENTS

| | | | |
|---|---|---|---|
| 2,381,804 | 8/1945 | Bremser | 239/128 |
| 2,822,789 | 2/1958 | Philips et al. | 239/128 |
| 4,071,009 | 1/1978 | Kraina | 123/198 E |
| 4,382,333 | 5/1983 | Nagashima et al. | 123/41.6 |

*Primary Examiner*—E. Rollins Cross

*Attorney, Agent, or Firm*—Stevens, Davis, Miller & Mosher

[57] ABSTRACT

An internal combustion power pack, comprising a fuel injector assembly, in particular for Diesel engines, which is air cooled, and in which are provided means for feeding and expelling said air to and from said fuel injector assembly which are separate from the remaining part of the ventilation air, and which are freely demountable.

4 Claims, 2 Drawing Figures

INTERNAL COMBUSTION POWER PACK WITH INJECTION PUMP VENTILATION SYSTEM

In order to keep constant the delivery characteristics of the fuel injection pumps of an internal combustion engine, particularly of Diesel type, it is known to be advisable to stabilize the operating temperature of the injection system at values as low as possible.

In air-cooled engines, it is for this purpose preferred to mount the injection pumps in such a way that they are not lapped by the air downstream of the cooling-air flow (hot-air) and, if possible, it is attempted to have the pumps struck by the flow of cool air upstream of the cooling system.

In this case, however, the risk exists that the cooling air, which has subsequently to pass through the fins of cylinders, heads and other exchangers, may foul these with the oil and fuel vapours that can be caused by transudations in the different flanges and connectors of the pumps and feed pipes.

Moreover, if the said pipes become damaged, the liquid fuel may be carried onto the aforesaid high-temperature exchange surfaces and, by vaporizing, pollute the air stream sometimes used for heating passenger compartments; in certain extreme cases, conditions critical for combustion risks can be produced.

The object of the present invention is to embody a ventilation of the assebly comprising the injection pumps, low pressure pipes and various connectors, which is separate from the ventilation of the cylinder and cylinder head fins and the finning of the other exchange means.

To achieve this object, the present invention embodies an internal combustion power pack comprising a fuel injection assembly, particularly for Diesel engines, which is air cooled, characterized by the fact that provision is made for means for feeding and expelling said air to or from said injection assembly, which means are separate from the remaining part of said ventilation air, and are freely demountable.

Figure 1:
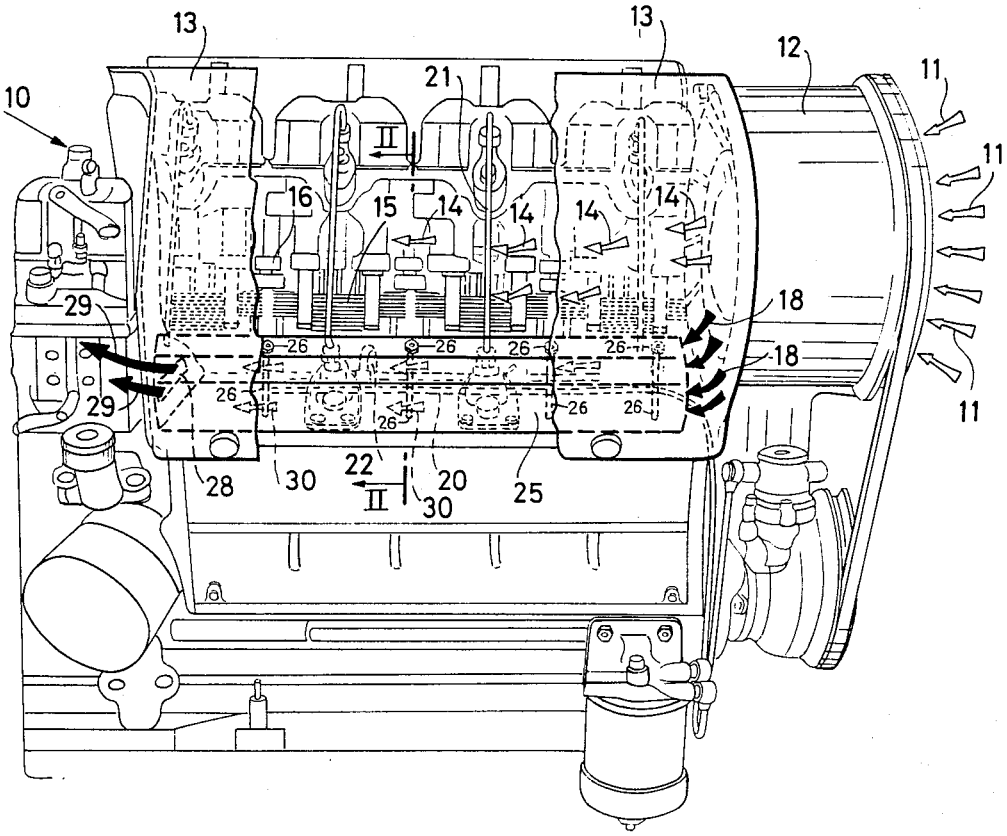
Figure 2:
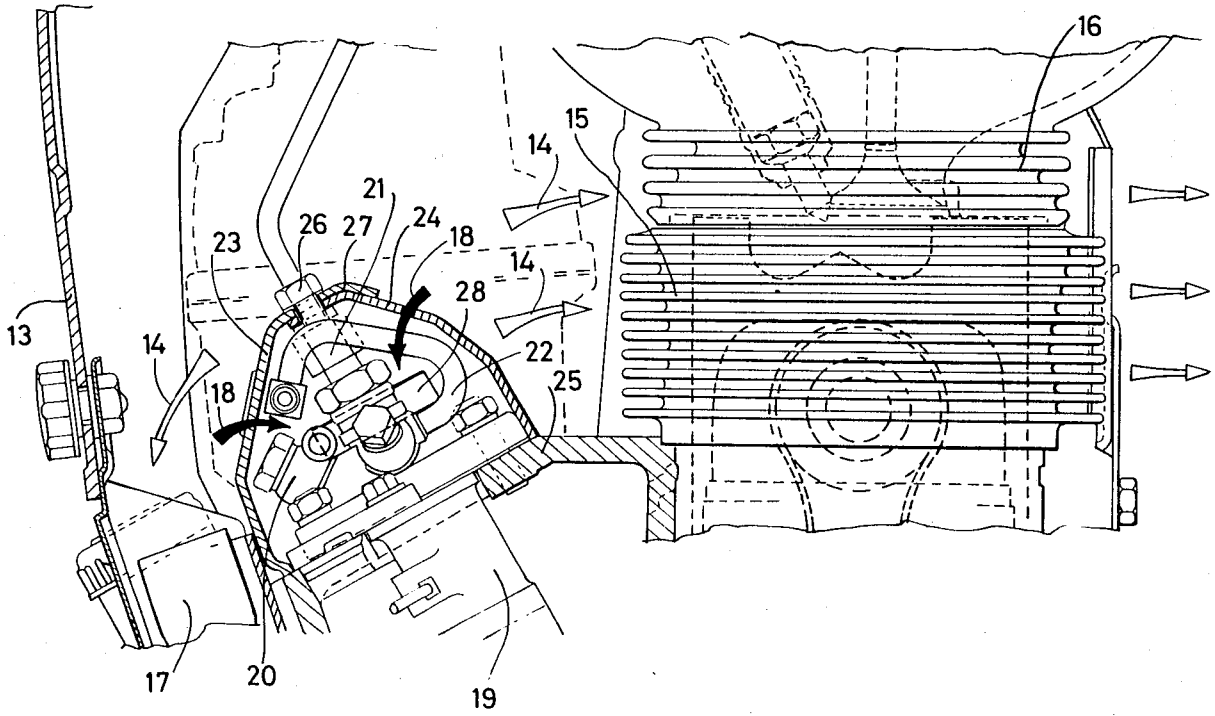

The structural and functional characteristics, and the advantages of an internal combustion power pack with a cooling system according to the invention, will be more fully understood from the following description referred to the attached drawings, in which:

FIG. 1 is a schematic perspective view of an engine with a cooling system according to the invention, and FIG. 2 is a partial cross-sectional view of the engine of FIG. 1.

With reference to the drawings, in an air-cooled engine indicated overall by 10, the cooling air aspirated in the direction of the arrows 11 by a fan 12 is sent through a conveyor 13 in the direction of the arrows 14 to cool the finning of the cylinders 15, of the heads 16, an oil cooler 17 and other hot parts.

A portion of said air by the fan 12 in the direction of the arrows 18, is directly conveyed to cool the injection pumps 19, the feed pipes 20 and the delivery connectors 21 of the pumps and other connectors such as the leak off pipes 22 of the pumps.

The said flow is conveyed in the direction of the arrows 30 and separated from the remaining flow by a pair of half-caps 23 and 24 which form a conduit and which are secured to the engine block 25 by screws 26 and seal closed, along a portion with surfaces 27 overlapped by means of the said screws 26.

A slot 28 in the end portion of the principal conveyor 13 against which the two half-caps 23 and 24 are seal-coupled, allows the exit of the cooling air in the direction of the arrows 29.

As is clearly seen, the cooling air streams are kept absolutely separate.

The air stream in the direction of the arrows 14 laps all the finned surfaces 15 and 16 and is also sent onto the oil cooler 17; the air stream in the direction of the arrows 18 penetrates the conduit formed by the half-caps 23 and 24, and runs along it in the direction shown by the arrows 30, cooling the pumps 19, the pipes 20, 21 and the connectors 22.

In said conduit there are oil or diesel fuel vapours which are entrained by said air stream towards the slot 28, and thence taken to atmosphere by the stream of air flowing in the direction shown by the arrows 29.

In this way, as the oil vapours are expelled downstream of the finned surfaces 15 and 16, and thus cannot foul them, which would cause deterioration of function or, in the case of leakage of liquid fuel, conditions involving the risk of combustion.

The separation of the two cooling air streams also improves the working conditions of the injection assembly, which is lapped only by cool air from the fan 12.

The two half-caps 23 and 24 can be constructed of low heat-exchange and noise-damping materials.

This measure protects the injection assembly from the irradiation of the hot surfaces of the power pack, such as the cylinders and cylinder heads, and also makes it possible to absorb and partially reduce the noise of the injection pumps during operation.

I claim:

1. An internal combustion power pack, for a diesel engine comprising cylinders in an engine block and a fuel injector assembly, which are cooled by cooling air, characterized by the fact that provision is made for means for feeding and expelling part of said cooling air to and from said fuel injector assembly which are separate from the remaining part of the cooling air, said means comprise a casing removably mounted on said engine block adjacent said injector assembly and defining an air cooling conduit for air cooling said injector assembly, said air cooling conduit being separate and parallel to an air cooling circuit provided for air cooling said cylinders.

2. A power pack according to claim 1, characterized by the fact that said means consist of two half-caps, adapted to be coupled one to the other and to form, with the engine block, a conduit for supplying cooling air to said fuel injector assembly.

3. A power pack according to claim 1, characterized by the fact that said means are noise-absorbing and acoustically insulating.

4. A power pack according to claim 1, characterized by the fact that said means receive part of the cooling air directly from a cooling fan of said power pack, and sends said cooling air directly towards the outside of said power pack.

* * * * *